United States Patent [19]

Vaagenes

[11] 4,093,973

[45] June 6, 1978

[54] ILLUMINATED COSTUME JEWELRY

[76] Inventor: Ronald Vaagenes, 43429 Proctor Rd., Canton, Mich. 48188

[21] Appl. No.: 698,290

[22] Filed: Jun. 22, 1976

[51] Int. Cl.[2] ..... F21L 15/08

[52] U.S. Cl. ..... 362/104; 63/15; 362/31

[58] Field of Search ..... 240/6.4 W, 6.4 R, 6.43, 240/2.25, 1 EL; 63/1 R, 15; 224/28 C

[56] References Cited

U.S. PATENT DOCUMENTS

| | | | |
|---|---|---|---|
| 3,392,276 | 7/1968 | Roman | 240/6.4 W X |
| 3,790,775 | 2/1974 | Rosenblatt | 240/6.4 W X |
| 3,804,307 | 4/1974 | Johnston | 240/6.4 W X |
| 3,986,144 | 10/1976 | Russo | 63/15 X |
| 4,012,629 | 3/1977 | Simms | 240/6.4 W |

*Primary Examiner*—Richard L. Moses
*Attorney, Agent, or Firm*—Robert D. Farkas

[57] ABSTRACT

An ornamental finger ring consists of a transparent cylindrical body having a colored liquid center, an incandescent light, a battery and a switch for causing illumination of the ring.

8 Claims, 3 Drawing Figures

ILLUMINATED COSTUME JEWELRY

BACKGROUND OF THE INVENTION

This invention relates generally to costume jewelry and particularly to costume jewelry having illumination means as an integral part thereof.

Although jewelry has been worn throughout the ages, it is only recently, with the advent of modern technology that new modes of jewelry including light as an integral part thereof have been developed. This so called 'mode' type costume jewelry has recently been used in rings, bracelets, pendents, and earrings, for example.

The present invention is directed to such illuminated costume jewelry which can be used to glow in one or more colors. Prior art costume jewelry of this type have had features which in some instances are not advantageous. For example, prior art jewelry such as bracelets have been constructed of clasped semicircular halves, remote switches that are not automatically activated and jewelry bodies which are the battery and used as the source of energy and when used out, the whole piece of jewelry must be discarded. In comparison the present invention teaches jewelry having a unitary rather than halved construction leaving a switch built into the jewelry as an integral part thereof which may be activated automatically upon wearing the jewelry. The energy source of the present invention is preferably a replaceable battery. The source of illumination may be electroluminescent, incandescent or flourescent.

SUMMARY OF THE INVENTION

Costume jewelry comprising:

(a) a transparent body;

(b) means within said body for imparting color thereto at least when illuminated;

(c) illuminating means within said body for causing said body to glow with the desired color;

(d) a battery mounted within said body for energizing said illuminating means; and (e) switching means coupled to said battery and illuminating means.

DETAILED DESCRIPTION OF THE PREFERRED EMBODIMENT

Figure 1:
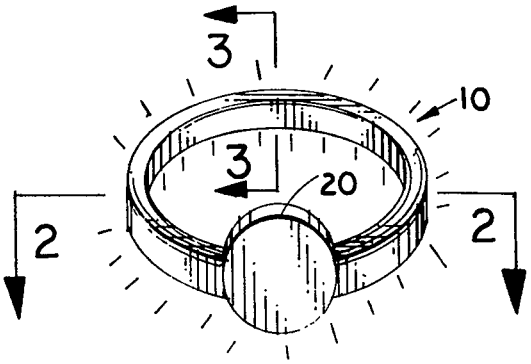
FIG. 1 is a perspective view of an ornamental ring mode in accordance with the invention.

Referring to FIG. 1, there is shown a perspective view of a piece of costume jewelry made in accordance with this invention. While the particular jewelry shown is a finger ring, the concepts incorporated herein have equal use in other costume jewelry such as bracelets, earrings and pendents.

Figure 2:
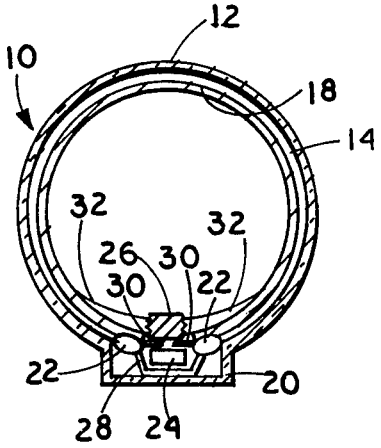
FIG. 2 is a top cross-sectional view of the ring of FIG. 1 taken through lines 2—2 of FIG. 1.
Figure 3:
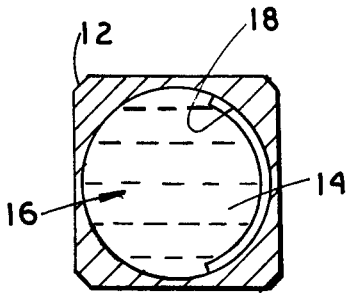
FIG. 3 is a cross-sectional view of the ring of FIG. 1 taken through lines 3—3 of FIG. 1.

As seen in FIG. 1 and more clearly in FIGS. 2 and 3 which are cross-sectional views through the ring shown in FIG. 1 along planes 2—2 and 3—3 respectively, the body of the ring 10 comprises a cylindrical wall 12 which fits about the wearers finger. The wall 12 if formed from a transparent material such as readily available plastics or acrylics, methocrylates, polystyrenes, polycarbonates or others. Color imparting means are provided within the body of the ring. In the embodiment shown here, the color imparting means consists of a liquid 14 which is inert to the plastic wall 12 contained within a cavity 16 formed within said wall 12 and extending circumferentially around the ring body. The liquid is a transparent solution which has dissolved therein coloring matter which either appears colored with normal white light or appears colored due to flourescence caused by ultra-violet light. An example of the former is an aqueous solution having commonly available vegetable dye matter or color indicating dye such as methyl red or methyl orange dissolved therein. An example of the latter is an solution of an organic solvent containing a flourescent organic or metal-organic dissolved therein. More particularly, many rare-earth chelates such as terfium acetybacetonate (green flourescence) or dysprosium acetylacetonate (purple flourescence) dissolved in alcohol or acetone in concentrations of 10 mg/liter will flouresce upon activation with ultra-violet light.

Alternatively, the wall 12 can have coloring means such as the aforementioned chelates dissolved in the plastic material of the wall 12. For example, terfium acetylacetonate readily dissolves in methacrylate imparting a green flourescence thereto when activated.

It is preferred in order to maximize the light output of the ring 10 that the portion of the wall 12 which is closest to the finger be provided with a reflective surface such as an aluminum thin fiber 18.

The wall 12 of the ring is preferably formed with a wide decorative front portion 20 which may be made to resemble a stove if desired. This front portion 20 extends outwardly from the remainder of the body wall 12 so as to provide a housing in which is mounted small illuminating means 22 such as incandescent or flourescent light bulbs and a battery 24 for energizing the illuminating means 22. Contact means are provided for coupling the battery 24 to the illuminating means 22 through a switch 26. The contact means shown comprises a contact bar 28 connected to one terminal of the battery 24 and to one side of each of the illuminating lamps 22 and contact springs 30 which extend from the other side of the filaments of the illuminating lamps 22. The contact springs 30 are caused to contact the second terminal of the battery 24 upon depression of the switch 26 mounted to the inner portion of the ring, that is the portion in contact with the finger of the wearer. The switch 26 is mounted on leaf spring means 32 such that when the ring is placed upon the finger of the wearer, the switch 32 is automatically depressed causing energizing of the illuminating means 22. Due to internal reflections the light emitted from the illuminating means is carried around the body of the ring causing it to glow.

While the embodiment discussed describes a ring, it should be obvious to one skilled in the art to extend the teachings herein to other jewelry pieces as well.

What is claimed is:

1. Costume jewelry comprising:

(a) a transparent body;

(b) means within said body for imparting color thereto at least when illuminated;

(c) illuminating means within said body for causing said body to glow with the desired color;

(d) a battery mounted within said body for energizing said illuminating means;

(e) switching means coupled to said battery and illuminating means; and (f) wherein said transparent body has a hollow core and said core containing said color imparting means.

2. The jewelry recited in claim 1, wherein said switching means is mounted on said body in a manner so as to cause energization of said illuminating means automatically when worn by a user.

3. The jewelry recited in claim 1, wherein said color imparting means is a colored liquid.

4. The jewelry recited in claim 1, wherein said color imparting means is a flourescent liquid and wherein said illuminating means emits light of a wavelength to cause flourescence of said liquid.

5. The jewelry recited in claim 4, wherein said flourescent liquid contains a flourescent rare earth chelate.

6. The jewelry recited in claim 1, wherein said body is formed from a plastic and wherein said illuminating means is a flourescent material dissolved in said plastic body.

7. The jewelry recited in claim 6, wherein said flourescent material is a rare rarth chealte.

8. The jewelry recited in claim 1, including a reflective surface over a portion of said hollow core.

* * * * *